US005438399A

United States Patent [19]

Asai

[11] Patent Number: 5,438,399

[45] Date of Patent: Aug. 1, 1995

[54] IMAGE FORMING APPARATUS HAVING TRANSFER VOLTAGE CONTROL

[75] Inventor: Jun Asai, Tokyo, Japan

[73] Assignee: Canon Kabushiki Kaisha, Tokyo, Japan

[21] Appl. No.: 182,384

[22] Filed: Jan. 18, 1994

Related U.S. Application Data

[63] Continuation of Ser. No. 613,006, Nov. 15, 1990, abandoned.

[30] Foreign Application Priority Data

Nov. 16, 1989 [JP] Japan ..... 1-296289

[51] Int. Cl.[6] ..... G03G 15/14

[52] U.S. Cl. ..... 355/273; 355/277

[58] Field of Search ..... 355/219, 271, 273, 277

[56] References Cited

U.S. PATENT DOCUMENTS

| | | | |
|---|---|---|---|
| 3,781,105 | 12/1973 | Meagher | 355/274 |
| 4,401,383 | 8/1983 | Suzuki et al. | 355/273 X |
| 4,977,430 | 12/1990 | Florack et al. | 355/277 X |
| 5,006,902 | 4/1991 | Araya | 355/271 |
| 5,010,370 | 4/1991 | Araya et al. | 355/271 X |
| 5,034,777 | 7/1991 | Ohzeki et al. | 355/277 X |
| 5,144,368 | 9/1992 | Ohzeki et al. | 355/271 X |
| 5,179,397 | 1/1993 | Ohzeki et al. | 355/271 X |
| 5,253,022 | 10/1993 | Takeuchi et al. | 355/271 X |

FOREIGN PATENT DOCUMENTS

| | | |
|---|---|---|
| 0323226 | 7/1989 | European Pat. Off. . |
| 0338546 | 10/1989 | European Pat. Off. . |
| 0367245 | 5/1990 | European Pat. Off. . |
| 59-012469 | 1/1984 | Japan . |
| 61-014671 | 1/1986 | Japan . |
| 0123385 | 5/1990 | Japan . |

*Primary Examiner*—A. T. Grimley
*Assistant Examiner*—Nestor R. Ramirez
*Attorney, Agent, or Firm*—Fitzpatrick, Cella, Harper & Scinto

[57] ABSTRACT

An image forming apparatus includes a movable image bearing member; an image forming device for forming an image on the image bearing member; a charging member press-contacted to or faced to the image bearing member to transfer the image from the image bearing member onto the transfer material passed therebetween; a bias voltage applying device for applying a bias voltage to the charging member, wherein the voltage applying device constant-voltage-controlled the charging member in a period when an image region of the image bearing member is present in the transfer position, and constant-current-controls the charging member in another period, and wherein a voltage applied to the charging member during the constant voltage control is a sum of a voltage provided during the constant current control and a predetermined voltage.

34 Claims, 5 Drawing Sheets

IMAGE FORMING APPARATUS HAVING TRANSFER VOLTAGE CONTROL

This application is a continuation of application Ser. No. 07/613,006 filed Nov. 15, 1990, now abandoned.

FIELD OF THE INVENTION AND RELATED ART

The present invention relates to an image forming apparatus such as an electrophotographic machine or an electrographic printer, more particularly to an image forming apparatus having an image transfer means in the form of a transfer roller.

In a known image forming apparatus wherein a toner image is formed on an image bearing member, and the toner image is transferred onto a transfer material, an image transfer means having a contact type transfer roller or a transfer belt is contacted to an image bearing member to form an image transfer position in the form of a nip formed therebetween. Into the nip, the toner image and the transfer material are inserted with the transfer means supplied with an image transfer bias, by which the toner image is transferred from the image bearing member onto the transfer material.

In such an image forming apparatus, it is desirable in order to effect a proper image transfer operation, that the transfer current per unit area of the transfer material during the transfer operation is within a predetermined range irrespective of the resistance or width of the transfer material so as to apply a proper amount of the electric charge onto the transfer material.

Generally, an image forming apparatus such as a copying machine is usable with different kinds of transfer materials. Depending on the size of the transfer material used the area in which the image bearing member or the transfer roller is in contact with the transfer material is different. Under the circumstances, if a constant current control is effected when the transfer bias is applied, the area in which the transfer means is directly contacted to the image bearing member is different because the size of the transfer material is different. Therefore, it is difficult to flow substantially constant current only through the transfer material irrespective of the transfer materials. The problem also arises from the thickness or the material of the transfer material as well as the size of the transfer material.

When, for example, the size of the transfer material supplied is small, and therefore, the contact area between the transfer roller and the image bearing member is too large, the constant current control through the transfer material is not satisfactory because the amount of charge applied to the transfer material sometimes is sufficient with the result of improper image transfer and a smaller toner retaining power on the transfer material leading to the scattering of the toner or the disturbance of the image. When, on the contrary, the size of the transfer material supplied is so large that the contact area between the transfer roller and the image bearing member is too small, the constant current control through the transfer material is also unsatisfactory because the amount of electric charge applied onto the transfer material is sometimes too large, with the result that the toner is electrically charged to the polarity opposite to the right polarity, which leads to local image transfer void.

In order to avoid the defects in the constant current control, it is considered that the transfer bias is constant-voltage-controlled. However, the roller or the belt used for the transfer roller or the transfer belt, has a resistance significantly changing depending on the ambient condition, particularly the humidity, although the change is also different depending on the materials used. In addition, paper which is most frequently used as the transfer material has the resistance significantly dependent on the ambient condition. Therefore, it is difficult to effect the stabilized image transfer operation irrespective of the size or the material of the transfer material or the ambient condition.

In order to solve the problems, U.S. Ser. No. 500,795 which has been assigned to the assignee of this application has proposed that for the purpose of simultaneously compensating for the variations in the resistances of the transfer material and the transfer roller or belt depending on the ambient condition, the constant current control is carried out when the transfer material is absent in the image transfer position, and when there is the transfer material in the transfer position, a constant voltage control is carried out with a voltage level provided by multiplying a coefficient and a voltage in the constant current control period.

However, such a combination of the constant current control and the constant voltage control is still not completely satisfactory.

For example, when the resistance of the transfer roller is small, the voltage level obtained by the constant current control is small. If, at this time, the resistance of the transfer material is large, the bias voltage required during the constant voltage control is large, because it is a sum of a voltage across the drum, the voltage across the transfer roller and the voltage across the transfer material. Because, however, the bias voltage provided in the constant current control is small, a required bias voltage is not provided. This results in less electric charge on the transfer material, and therefore, improper image transfer or disturbance of the image.

This stems from the fact that the voltage level of the transfer bias is obtained on the premise that the ambient conditions in the constant current control is the same as those in the constant voltage control, in other words, the variation in the resistance of the roller or the like depending on the ambience is detected, the change in the resistance of the transfer material is simultaneously corrected on the assumption that the resistance of the transfer material is that under the same ambience. Therefore, the proper voltage is not applied to the transfer material not yet saturated in the ambience, a high resistance transfer material such as OHP sheet or the like or the dried transfer material immediately after being subjected to the image forming operation in the case of duplex copying machine.

SUMMARY OF THE INVENTION

Accordingly, it is a principal object of the present invention to provide an image forming apparatus wherein stabilized images can be obtained irrespective of resistance change of the transfer roller depending on the ambience.

It is another object of the present invention to provide an image forming apparatus wherein a stabilized image can be provided irrespective of the resistance change of the transfer material depending on the ambience change or the like.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
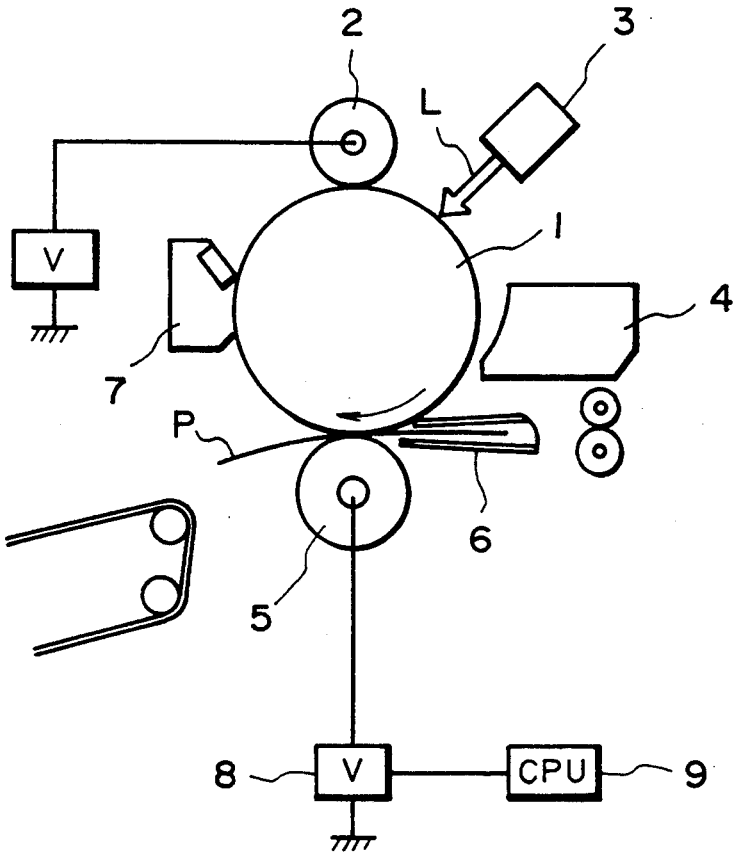
FIG. 1 is a side view of a major part of an image forming apparatus according to an embodiment of the present invention.

Referring to FIG. 1, there is shown an image forming apparatus having a cylindrical image bearing member (photosensitive member) 1 rotatable in a direction indicated by an arrow about an axis perpendicular to the sheet of the drawing. The photosensitive member 1 is electrically charged to a negative polarity by charging means in the form of a charging roller 2 contacted to the photosensitive member 1 (a discharging wire is usable in place of the charging roller 2). The charged photosensitive member 1 is exposed to light L in accordance with image information by an exposure means 3, by which an electrostatic latent image is formed on the photosensitive member 1 in accordance with the image information. A developing means 4 develops the electrostatic latent image thus formed, with toner having been charged to a positive polarity into a visualized image.

The transfer roller having an axis extending in the same direction as that of the photosensitive member 1 is made of EPDM and is contacted to the photosensitive member 1. By the transfer roller 5, the toner image described above is transferred from the photosensitive member 1 onto the transfer material P in the transfer position which is the region between the photosensitive member 1 and the transfer roller 5. The transfer material P has been fed along a conveyance passage 6. To the transfer roller 5, the transfer bias of the negative polarity is applied.

Between the transfer roller 5 and the photosensitive member 1, a clearance may be provided if it is smaller than the thickness of the transfer material P. In such a case, the transfer material P is pressed between the photosensitive member 1 and the transfer roller 5.

Thereafter, the transfer material P is separated from the photosensitive member 1, and is conveyed along the passage 6 to an unshown image fixing station wherein the toner image is fixed on the transfer material P.

On the other hand, the photosensitive member from which the image has been transferred, is cleaned by a cleaning device 7, so that the toner remaining on the photosensitive member is removed to be prepared for the repeated image forming operation.

The transfer roller 5 is supplied with a predetermined bias voltage at predetermined timing in accordance with an image signal from a CPU (central processing unit) 9 by a voltage source (bias applying means) 8 which is capable of effecting constant voltage control and constant current control (ATVC: active transfer voltage control).

Figure 2:
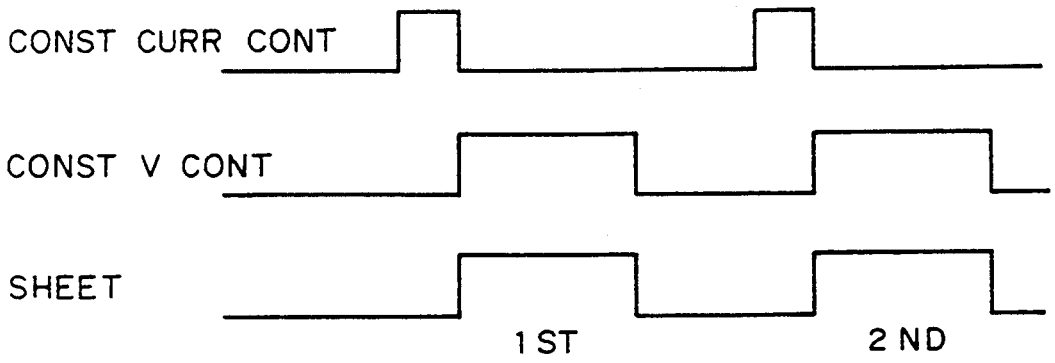
FIG. 2 is a timing chart illustrating operation of the apparatus of FIG. 2.

FIG. 2 shows the operational timing of the constant current control and the constant voltage control.

As will be understood from this Figure, the constant current control is carried out when the sheet is absent from the transfer region, and a constant voltage control is effected when the sheet is present in the transfer region. In other words, when the image region of the image bearing member (the region having the toner image) is in the transfer position, the voltage source 8 effects the constant voltage control to the transfer roller 5, and the voltage source 8 effects the constant current control during the other period.

Thus, the transfer roller 5 is constant-current-controlled when the non-image area of the photosensitive member 1 not having the toner image is in the transfer position, that is, when the transfer material is absent from the transfer position (non-passage period), as shown in FIG. 2. Such a period occurs after the CPU 9 receives the image-on signal, more particularly, upon the pre-rotation period for the purpose of warming the fixing device up or in the sheet interval period between end of one sheet and a start of the next sheet when plural images are continuously formed. In this embodiment, the constant current through the transfer roller was −1 micro-ampere during the non-passage period. During this period, a basic datum for obtaining a voltage level required during the constant voltage control is obtained ($V_D$).

Then, the voltage $V_D$ across the transfer roller 5 is stored in an unshown storing means. When the image region of the photosensitive member, in other words, the transfer material is present in the transfer position, the CPU 9 supplies a constant voltage control signal to the voltage source 8. Then, the voltage source 8 effects the constant voltage control to the transfer roller 5 with a constant voltage level which is provided by adding a predetermined constant voltage to the stored voltage $V_D$. By the constant voltage control, the toner image is transferred from the photosensitive member 1 to the transfer material P. Here, the voltage $V_D$ may be an average of plural samples of voltages during the constant current control period.

The voltage V actually applied to the transfer roller 5 during the constant voltage control (transfer operation) is determined in the following manner.

Figure 3A:
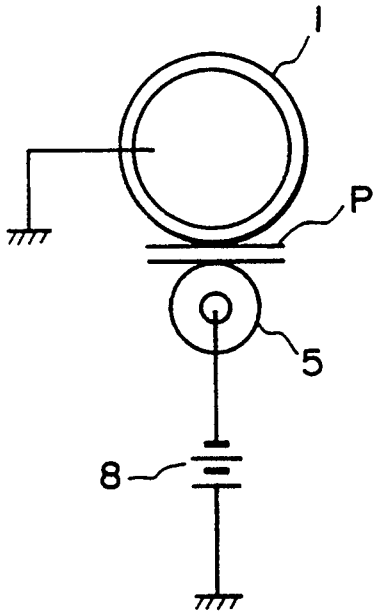
FIG. 3A is a sectional view in which a transfer material is present between the photosensitive member and the transfer roller.
Figure 3B:
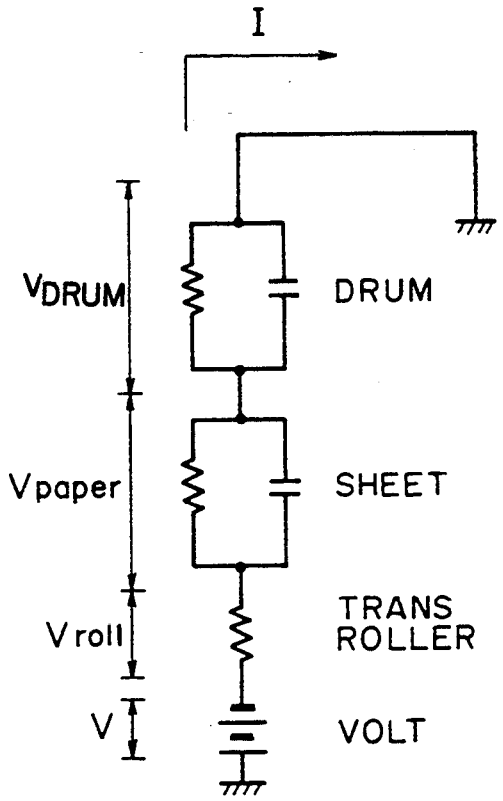
FIG. 3B shows an equivalent circuit of the state of FIG. 3A.

FIG. 3A schematically shows the state wherein the transfer material P is present in the transfer position. FIG. 3B shows an equivalent circuit thereof. In FIG. 3B, the transfer roller is represented as a resistor, and the transfer material P and the photosensitive member 1 are represented by parallel circuits constituted by a resistor and a capacitor. The voltage V applied to the transfer roller 5 during the period for transferring the toner image from the photosensitive member 1 to the transfer material P for effecting the proper image transfer operation is:

$$V = Vroll + Vpaper + VDRUM$$

When a certain density of electric charge is applied to a unit area of the toner image on the photosensitive member in the transfer operation, that is, when a certain current flows through a unit area of the toner image, the efficiency of the toner transfer is maximum, and the image quality of the copy image is optimum. The current level should not be larger and should not be smaller.

If the voltage across the transfer roller is constant, the electric charge (current) of the toner image per unit area is constant. In order to provide the good quality of the image under different ambient conditions and with different kinds of the transfer material, it is desired that the optimum current flows per unit area of the toner image. Then, it is desirable that a transfer current providing it is obtained.

Therefore, the characteristics of the voltages Vroll, Vpaper, VDRUM will be analyzed.

Figure 4:
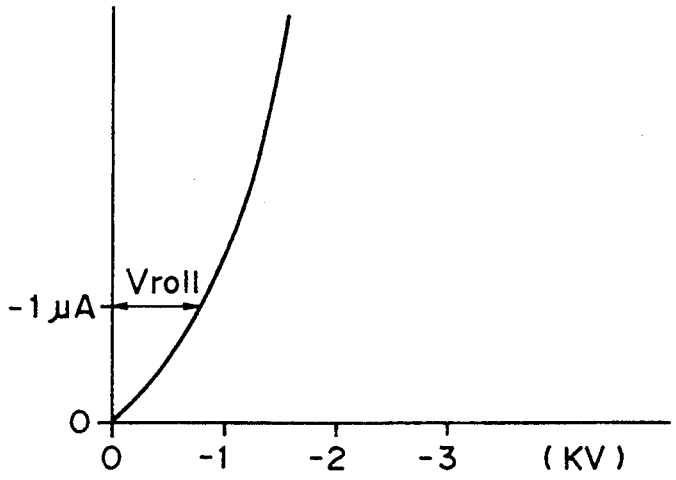
FIG. 4 is a graph of voltage-current characteristics of the transfer roller under a low temperature and low humidity condition.
Figure 5:
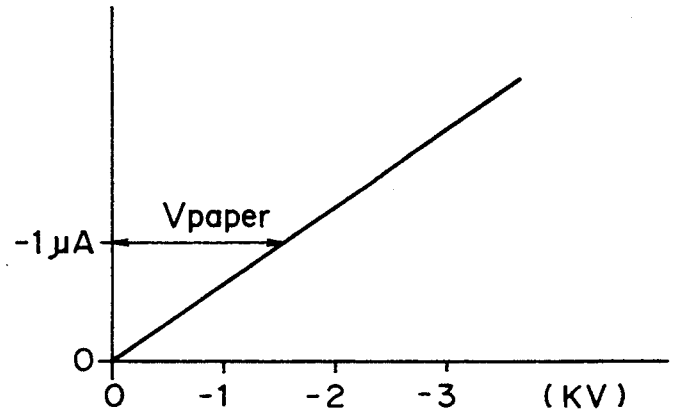
FIG. 5 is a graph showing voltage-current characteristics of an OHP sheet under the same ambient condition.
Figure 6:
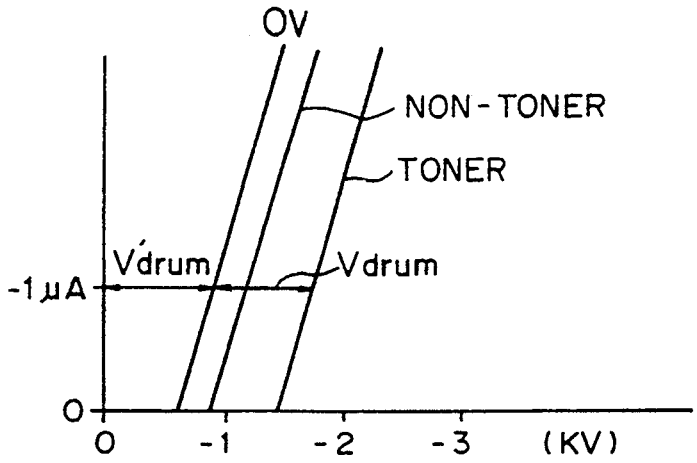
FIG. 6 is a graph of voltage-current characteristics of an OPC photosensitive member under the same ambient condition.

FIGS. 4, 5 and 6 show the voltage-current characteristics (V-I characteristics) of the transfer roller, the transfer material (OHP sheet) and the OPC photosensitive member under the low temperature and low humidity (15° C. and 10% RH).

Figure 7:
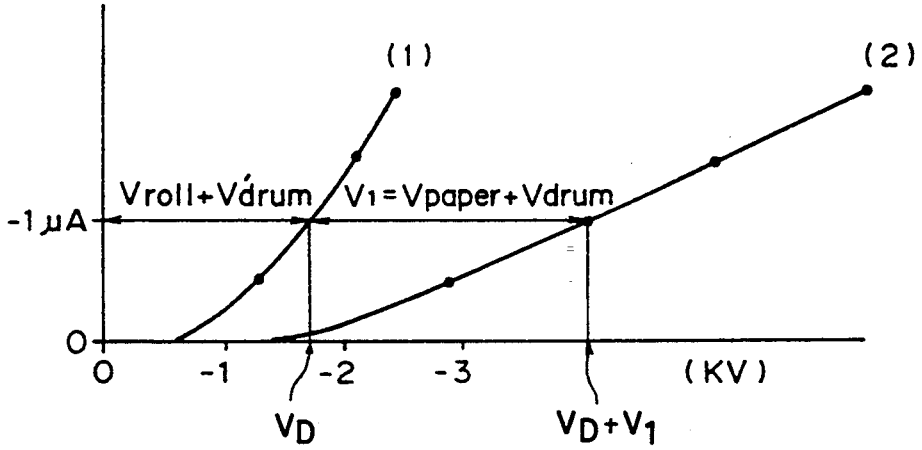
FIG. 7 is a graph of voltage-current characteristics under the same ambient condition when the sheet is not present and when the OHP sheet is present.

FIG. 7 shows the V-I characteristics of all of them combined.

More particularly, the line 0 V in FIG. 6 shows the V-I characteristics of the photosensitive member in the non-passage period, that is, when the photosensitive member is not electrically charged. The line represented by "non-toner" represents the V-I characteristics of the charged photosensitive member without toner image (exposed area), and the line indicated by "toner" represents the V-I characteristics of the charged photosensitive member in the image portion (the portion deposited with the toner) (sheet passage period).

In FIG. 7, the curvature (1) represents the V-I characteristics during the non-passage period when the photosensitive member has the potential of 0 V relative to the transfer roller (that is, during the constant current control), and the curve (2) shows the V-I characteristics when the OHP sheet is passed through the transfer station.

In other words, the curve (1) in FIG. 7 is the V-I characteristics during the constant current control, and therefore, it is a sum of the V-I characteristics of the transfer roller (Vroll) shown in FIG. 4 and the V-I characteristics of the photosensitive member shown by 0 V curve of FIG. 6 Vdrum. The curve (2) of FIG. 7 represents the V-I characteristics during the constant voltage control, and therefore, it is a sum of the curve (1), the V-I characteristics of the transfer material (Vpaper) shown in FIG. 5 and the added V-I characteristics "toner" over "OV" of FIG. 6 (Vdrum).

Assuming that the optimum current during the transfer action (sheet passage period) is −1 microampere, the optimum voltage V is selected so that the current of −1 micro-ampere flows through the transfer material P or through the toner image on the photosensitive member. To accomplish this, the transfer roller 5 is constant-current controlled during the sheet-non-passage period in which the transfer material is absent from the transfer position. The voltage $V_D$ in FIG. 7 is a voltage when the constant current of −1 micro-ampere flows during the non-passage period. That is, it is the voltage (Vroll+V'drum) provided when a constant current flows through the circuit shown in FIG. 3B without paper with the charge potential of the photosensitive member being, when the constant current control is effected during non-passage period. Therefore, the voltage $V_D$ is the voltage during the constant current control providing the optimum current during the transfer operation.

During this, $V_D = -1.7$ (KV) was provided. The voltage $V_D$ is held for the purpose of the subsequent constant voltage control during the transfer action. On the basis of the stored voltage $V_D$, the optimum voltage level V during the constant voltage control is provided.

In the constant voltage control, a toner image is on the photosensitive member or drum 1. In addition, since the transfer material P is present between the photosensitive member 1 and the transfer roller 5, the voltage corresponding thereto is added to the voltage $V_D$. The potential in the toner deposited portion is predetermined in the apparatus. As the voltage through the transfer material is, in this embodiment, a voltage corresponding to the resistance of a highest resistance used in this apparatus (OHP sheet, for example) under the low temperature and low humidity condition (5° C., 10% RH, for example). When any transfer material is used in the apparatus, the voltage corresponding to the highest resistance of the transfer material is used. Therefore, no higher resistance of the transfer material is present in the apparatus, and the resistance of the transfer material is not higher than that in any used condition of the apparatus. Therefore, the voltage added to the detected voltage $V_D$ is constant.

By adding the constant voltage to the voltage $V_D$, a good voltage V can be obtained even if the resistance of the used transfer material does not correspond to the ambient condition under which the constant current control is carried out.

From FIGS. 5 and 6, a voltage Vpaper = −1.5 KV and Vdrum = −1.7 − V'drum = −0.8 KV were obtained as the voltages to be added to the voltage $V_D$. Therefore, the voltage V to be applied during the constant voltage control is $V_D$ +V1, more particularly, V = −4.0 KV. The current through the transfer material at this time will be understood to be −1 microampere from FIG. 7, and therefore, good image transfer operation is provided.

Figure 8:
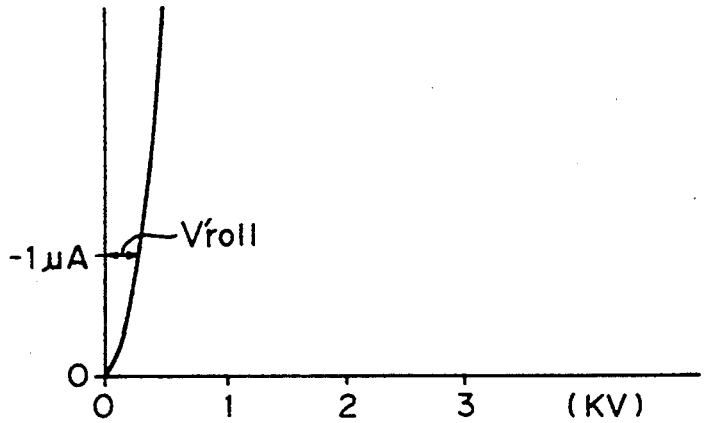
FIG. 8 is a graph of current-voltage characteristics of a transfer roller under a high temperature and high humidity condition.
Figure 9:
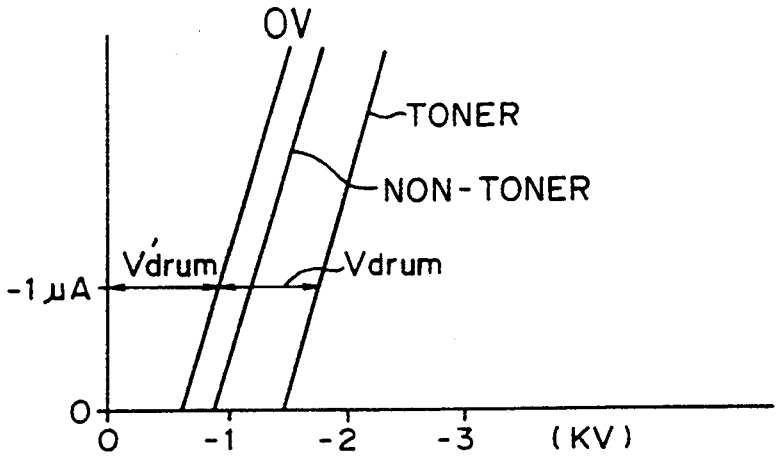
FIG. 9 is a graph of voltage-current characteristics of an OPC photosensitive member under the same ambient condition.
Figure 10:
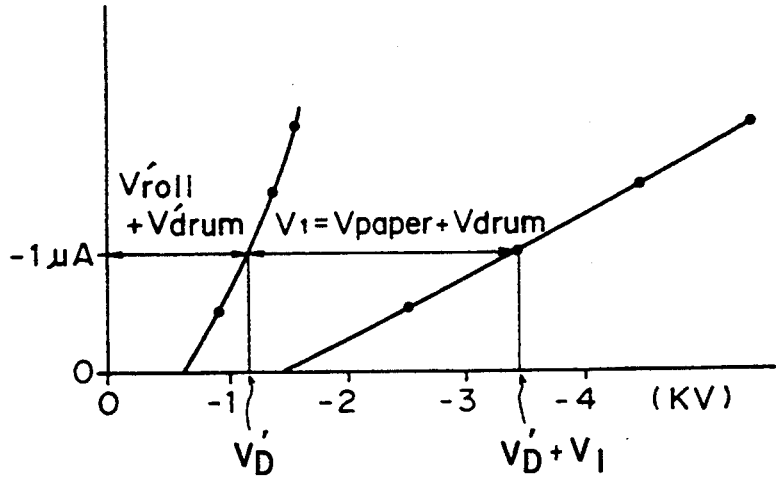
FIG. 10 is a graph of voltage-current characteristics under the same ambient condition when the sheet is not present and when an OHP sheet is present.

FIGS. 8 and 9 show the V-I characteristics of the transfer roller and the OPC photosensitive member under the high temperature and high humidity ambient conditions (32.5° C. and 90%RH). FIG. 10 is the V-I characteristics when the transfer roller is combined with FIG. 5.

Under a high humidity condition, the V-I characteristics of the transfer roller are as shown in FIG. 8, which is different from that under the low humidity condition (FIG. 4). However, the voltage across the photosensitive member is as shown in FIG. 9, and therefore, is not hardly different from that during under the low humidity (FIG. 6).

With these characteristics, if the current of −1 micro-ampere flows during the constant current control, $V_D'$ (V'roll+V'drum) can be provided. Thereafter, during the constant voltage control, a constant voltage V1 (=Vpaper+Vdrum) under any ambient conditions, and the transfer roller is supplied with the transfer bias voltage of $V_D'$+V1. The current through the transfer material at this time is −1 micro-ampere as will be obtained from FIG. 10, and therefore, good image transfer operation is possible.

As described in the foregoing, according to the present invention, the change in the resistance of the transfer roller can be, in effect, detected, and the good image transfer operation is possible irrespective of the resistance of the transfer material and the kinds of the transfer material.

In the foregoing embodiment, the surface potential of the photosensitive member relative to the transfer roller during the constant current control is 0 V, but it is not limited to 0 V.

It is considered that the constant current control is carried out when the surface potential of the photosensitive member is that after a blank exposure or that after the development. In this case, the constant voltage added during the constant voltage control is only Vpaper.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

image forming means for forming an image on said image bearing member;

a charging member contactable with a transfer material at a transfer position to transfer the image from said image bearing member to the transfer material;

voltage applying means for applying a voltage to said charging member, said voltage applying means applying a constant voltage between said charging member and said image bearing member when the transfer material is present at the transfer position, wherein said voltage applying means applies a constant current to said charging member during a time period in which the transfer material is absent from the transfer position;

wherein the constant voltage is a sum of a voltage provided during application of the constant current and a predetermined voltage.

2. An apparatus according to claim 1, wherein said charging member and the transfer material have resistances which vary depending on ambient conditions.

3. An apparatus according to claim 2, wherein the ambient conditions include ambient humidity and ambient temperature.

4. An apparatus according to claim 1, wherein said image forming means includes charging means for charging said image bearing member, exposure means for exposing said image bearing member to light in accordance with image information, and means for forming a toner image by depositing toner to a latent image provided by said exposure means.

5. An apparatus according to claim 4, wherein the voltage provided during application of the constant current corresponds to a sum of a voltage across said charging member during application of the constant current and a voltage across said image bearing member not charged by said charging means during application of the constant current.

6. An apparatus according to claim 4, wherein the voltage provided during application of the constant current corresponds to a sum of a voltage across said charging member during application of the constant current, and a voltage across said image bearing member during application of the constant current.

7. An apparatus according to claim 4, wherein the application of the constant current is carried out before said image bearing member is charged by said charging means.

8. An apparatus according to claim 4 or 5, wherein the predetermined voltage corresponds to a sum of a potential difference between a potential of a toner image portion of said image bearing member and a potential of a toner image portion of said image bearing member relative to the charging member as the image bearing member approaches the transfer position during the constant current application, and a voltage across the transfer material in the case the constant current flowed through a transfer material having a maximum resistance.

9. An apparatus according to claim 8, wherein the transfer material having the maximum resistance is a transfer material left in a low temperature and low humidity condition.

10. An apparatus according to claim 7, wherein the voltage provided during the application of the constant current corresponds to a sum of a voltage across said charging member and a voltage across said image bearing member during application of the constant current.

11. An apparatus according to claim 8, wherein the maximum resistance transfer material is an OHP transparent sheet kept under 15° C. and 10% of relative humidity.

12. An apparatus according to claim 8, wherein the maximum resistance transfer material is plain paper kept under 15° C. and 10% of relative humidity.

13. An apparatus according to claim 8, wherein the potential of said image bearing member relative to the charging member as said image bearing member approaches the transfer position during the constant current application is substantially 0.

14. An apparatus according to claim 1, wherein said charging member is contacted to said image bearing member.

15. An apparatus according to claim 1, wherein said transfer position is a position where said image bearing member and said charging member are faced to each other.

16. An apparatus according to claim 1, wherein the application of the constant current is carried out before image transfer.

17. An apparatus according to claim 1, wherein said charging member is in the form of a roller.

18. An apparatus according to claim 1, wherein said charging member includes EPDM layer.

19. An apparatus according to claim 1, wherein the voltage provided during the constant current application corresponds to a sum of a voltage applied to said charging member during the constant current application and a voltage applied to said image bearing member during the constant current application.

20. An apparatus according to claim 1, wherein said predetermined voltage is constant independently of the voltage provided during application of the constant current.

21. An image forming apparatus comprising, a movable image bearing member;

image forming means for forming an image on said image bearing member, said image forming means including charging means for charging said image bearing member, exposure means for exposing said image bearing member to light in accordance with an image signal, and means for forming a toner image by depositing toner to a latent image provided by said exposure means;

a charging member contactable with a transfer material at a transfer position to transfer the image from said image bearing member to the transfer material;

voltage applying means for applying a voltage to said charging member, said voltage applying means applying a constant voltage between said charging member and said image bearing member when the transfer material is present at the transfer position, wherein said voltage applying means applies a constant current to said charging member during a time period in which the transfer material is absent from the transfer position;

wherein the constant voltage is a sum of a voltage provided during the application of the constant current and a predetermined voltage, wherein the predetermined voltage corresponds to a sum of a potential difference between a potential of the toner image portion of said image bearing member and a potential of said image bearing member relative to the charging member as the image bearing member approaches the transfer position during the constant current application, and a voltage across the transfer material in the case where constant current flows through a transfer material having a maximum resistance.

22. An image forming apparatus, comprising:

a movable image bearing member;

image forming means for forming an image on said image bearing member, said image forming means including charging means for charging said image bearing member, exposure means for exposing said image bearing member to light in accordance with an image signal, and means for forming a toner image by depositing toner to a latent image provided by said exposure means;

a charging member contactable with a transfer material at a transfer position to transfer the image from said image bearing member to the transfer material;

voltage applying means for applying a voltage to said charging member, said voltage applying means applying a constant voltage between said charging member and said image bearing member when the transfer material is present at the transfer position, wherein said voltage applying means applies a constant current to said charging member during a time period in which the transfer material is absent from the transfer position;

wherein the constant voltage is a sum of a voltage provided during the application of the constant current and a predetermined voltage, wherein the predetermined voltage corresponds to a sum of a potential difference between a potential for the toner image portion of said image bearing member and a potential of said image bearing member relative to the charging member as the image bearing member approaches the transfer position during the constant current application, and a voltage across the transfer material in the case the constant current flows through the transfer material which is in the form of an OHP transparent sheet and which is left under 15° C. and 10% relative humidity.

23. An image forming apparatus, comprising:

a movable image bearing member;

image forming means for forming an image on said image bearing member, said image forming means including charging means for charging said image bearing member, exposure means for exposing said image bearing member to light in accordance with an image signal, and means for forming a toner image by depositing toner to a latent image provided by said exposure means;

a charging member contactable with a transfer material at a transfer position to transfer the image from said image bearing member to the transfer material;

voltage applying means for applying a voltage to said charging member, said voltage applying means applying a constant voltage between said charging member and said image bearing member when the transfer material is present at the transfer position, wherein said voltage applying means applies a constant current to said charging member during a time period in which the transfer material is absent from the transfer position;

wherein the constant voltage is a sum of a voltage provided during application of the constant current and a predetermined voltage, wherein the predetermined voltage corresponds to a sum of a potential difference between a potential of the toner image portion of said image bearing member and a potential of said image bearing member relative to the charging member as the image bearing member approaches the transfer position during the constant current application, and a voltage across the transfer material in the case the constant current flows through the transfer material which is in the form of plain paper and which is left under 15° C. and 10% relative humidity.

24. An apparatus according to claim 21, 22 or 23, wherein the potential of said image bearing member relative to the charging member as said image bearing member approaches the transfer position during the constant current application is substantially 0.

25. An image forming apparatus, comprising:

a movable image bearing member;

image forming means for forming a toner image on said image bearing member;

a charging member contactable with a transfer material at a transfer position to transfer the image from said image bearing member to the transfer material;

power supply means for supplying a voltage to said charging member while the transfer material is present at the transfer position;

determining means for determining the voltage to be applied to said charging member as a function of a voltage which is produced when a voltage is applied to said charging member without the transfer material at the transfer position, wherein said function includes adding a variable value based on a change of electric resistance of said charging member and a constant value which is constant regardless of change of the resistance of the transfer material.

26. An apparatus according to claim 25, wherein the voltage produced is a voltage produced between said charging member and said image bearing member when the constant current is supplied to said charging member.

27. An apparatus according to claim 25, wherein the voltage applied between said charging member and said image bearing member during the transfer operation corresponds to a sum of the produced voltage and the constant value.

28. An apparatus according to claim 27, wherein the voltage produced is a voltage produced between said charging member and said image bearing member when the constant current is supplied to said charging member.

29. An apparatus according to claim 28, wherein the constant value corresponds to a sum of a potential difference between a potential of a toner image portion of said image bearing member and a potential of a toner image portion of said image bearing member relative to the charging member as said image bearing member approaches the transfer position during the constant current application, and a voltage across the transfer material in the case the constant current flowed through a transfer material having a maximum resistance.

30. An apparatus according to claim 28, wherein the potential of the toner image portion of said image bearing member relative to the charging member as the image bearing member approaches the transfer position during the constant current application is substantially 0.

31. An apparatus according to claim 29, wherein the maximum resistance transfer material is plain paper kept under 15° C. and 10% of relative humidity.

32. An apparatus according to claim 29, wherein the maximum resistance material is an OHP transparent sheet kept under 15° C. and 10% of relative humidity.

33. An apparatus according to claim 18, wherein the constant value is constant independently of the voltage produced.

34. An apparatus according to claim 18, wherein said charging member is contacted to said image bearing member.

* * * * *

UNITED STATES PATENT AND TRADEMARK OFFICE

CERTIFICATE OF CORRECTION

PATENT NO. : 5,438,399
DATED : August 1, 1995
INVENTOR(S) : Jun Asai

It is certified that error appears in the above-indentified patent and that said Letters Patent is hereby corrected as shown below:

COVER PAGE

Under [56] References Cited, Foreign Patent Documents, insert --0391306 10/1990 European Pat. Off.--.

COLUMN 1

Line 54, "sufficient" should read --insufficient--.

COLUMN 3

Line 9, "Fig. 2" should read --FIG. 1--.

COLUMN 5

Line 7, "VDRUM" should read --$V_{DRUM}$--;
Line 26, "VDRUM" should read --$V_{DRUM}$--; and
Line 44, "curvature (1)" should read --curve (1)--.

COLUMN 6

Line 62, "not" should be deleted.

COLUMN 8

Line 26, "claim 7" should read --claim 8--.

UNITED STATES PATENT AND TRADEMARK OFFICE

CERTIFICATE OF CORRECTION

PATENT NO. : 5,438,399

DATED : August 1, 1995

INVENTOR(S) : Jun Asai

It is certified that error appears in the above-indentified patent and that said Letters Patent is hereby corrected as shown below:

COLUMN 12

Line 3, "claim 28" should read --claim 29--;
Line 15, "claim 18" should read --claim 25--; and
Line 18, "claim 18" should read --claim 25--.

Signed and Sealed this

Fourteenth Day of November, 1995

Bruce Lehman

*Attest:*

BRUCE LEHMAN

*Attesting Officer*

*Commissioner of Patents and Trademarks*